US007055873B2

(12) United States Patent
Qing

(10) Patent No.: US 7,055,873 B2
(45) Date of Patent: Jun. 6, 2006

(54) STORM DOOR PUSH OR TURN LOCK METHOD OF USING SAME

(75) Inventor: Wu Feng Qing, Chong Xing Town (CN)

(73) Assignee: Frank Char, Hong Kong (HK)

( * ) Notice: Subject to any disclaimer, the term of this patent is extended or adjusted under 35 U.S.C. 154(b) by 0 days.

(21) Appl. No.: 10/427,023

(22) Filed: Apr. 30, 2003

(65) Prior Publication Data

US 2004/0070216 A1 Apr. 15, 2004

Related U.S. Application Data

(60) Provisional application No. 60/376,663, filed on Apr. 30, 2002.

(51) Int. Cl.
*E05C 3/16* (2006.01)

(52) U.S. Cl. ..... 292/226; 292/336.3

(58) Field of Classification Search ..... 292/336.3, 292/126, 226

See application file for complete search history.

(56) References Cited

U.S. PATENT DOCUMENTS

| | | | | |
|---|---|---|---|---|
| 2,801,869 | A * | 8/1957 | George | 292/226 |
| RE24,426 | E * | 2/1958 | Quinn | 292/67 |
| 2,851,871 | A * | 9/1958 | Newell | 70/150 |
| 2,950,137 | A * | 8/1960 | Check | 292/228 |
| 3,387,876 | A | 6/1968 | Lyons | |
| 5,149,154 | A | 9/1992 | Shaanan | |
| 5,947,535 | A | 9/1999 | Baker | |
| 2003/0227180 | A1 * | 12/2003 | Tweedt | 292/336.3 |

* cited by examiner

*Primary Examiner*—Gary Estremsky
(74) *Attorney, Agent, or Firm*—McKee, Voorhees & Sease, P.L.C.

(57) ABSTRACT

A latch mechanism for a storm door including a nose and a handle operably connected to a spindle that is operatively connected to an exterior handle. The handle and nose are rotatably secured to a linker that is secured to the spindle. The handle includes a cam that, upon rotation, presses against the upper portion of the nose. This causes the nose to rotate on the linker and retracts the front of the nose away from the catch on the interior wall or door jamb.

The spindle is inserted through a spindle cylinder that is in operative contact with the linker assembly and rotatably secured to the body of the storm door by a mounting bracket. The spindle cylinder allows the handle, nose and linker to be rotated, thereby causing the nose to swing away from the catch.

15 Claims, 5 Drawing Sheets

STORM DOOR PUSH OR TURN LOCK METHOD OF USING SAME

CROSS-REFERENCE TO RELATED APPLICATIONS

This application claims priority under 35 U.S.C. § 119 of a Provisional Application, U.S. Ser. No. 60/376,663 filed Apr. 30, 2002, which application is hereby incorporated by reference in its entirety.

BACKGROUND OF THE INVENTION

1. Field of the Invention

The present invention relates generally to a storm door including a latch mechanism and more specifically to a latch mechanism that includes a securing member which may be actuated by either pushing on or turning a handle.

2. Problems in the Art

Storm doors are typically mounted in the same door jamb as the main full size door. The thickness of the main door leaves little room for a storm door, thus space is at a premium.

Storm doors typically have either an internal latch mechanism that is actuated by turning a knob or handle or an external latch mechanism that is of the push button/handle variety. Prior attempts to combine these two styles of latching mechanisms have included modifications to the turning bar and bolt of an internal style latch mechanism. Such attempts are shown and discussed in U.S. Pat. No. 5,947,535 to Baker. Baker allows the user to open the door by pushing in or pulling out the entire handle assembly. This can be cumbersome in a storm door setting where space is of the essence.

Securing a latch mechanism to the exterior portions of a storm door allows the storm door to remain relatively thin. A thin storm door can more easily fit into the door jambs of most homes. Moreover, the use of latch mechanisms on the exterior of a storm door also eases installation and repair.

Currently such latch mechanisms typically include a handle which is pushed in to activate the latching mechanism. To the contrary, the handles or knobs on most typical full size doors are turned. In an urgent situation, the ability of the storm door exterior latch to be actuated by either turning a handle or pushing a handle may avoid confusion and save precious time. It is therefore desirable to provide an exterior latch mechanism for a storm door that can be actuated by either pushing or turning the handle.

FEATURES OF THE PRESENT INVENTION

A general feature of the present invention is the provision of a latch mechanism that overcomes the problems in the prior art.

A further feature of the present invention is the provision of a latch mechanism that can be actuated by turning a handle.

Another feature of the present invention is the provision of a latch mechanism that can be actuated by pushing the handle.

A further feature of the present invention is the provision of a storm door with a latch mechanism that can use a conventional spindle and bolt to connect to an exterior turn-style handle.

A further feature of the present invention is the provision of a latch mechanism that can be operated in the space required for a typical storm door.

Another feature of the present invention is the provision of a latch mechanism that allows the storm door to remain as thin as possible.

A still further feature of the present invention is the provision of a latch mechanism that can be secured to the storm door without the need for a mortise.

These, as well as other features and advantages of the present invention, will become apparent from the following specification and claims.

BRIEF SUMMARY OF THE INVENTION

The present invention generally comprises a storm door with a latch mechanism including a handle and a nose. The handle of the present invention is operably connected to a spindle that is operatively connected to an exterior handle. Upon turning either of the handles or pushing the interior handle, the nose is retracted or slid away from the catch secured to the interior wall or door jamb and the door may be opened.

Initially, the handle and nose are rotatably secured to a linker. Rotation of the handle about the securement point on the linker occurs when a user pushes in on the handle. The handle includes a rotation arm or cam that, upon rotation, presses against the upper portion of the nose. This causes the nose to rotate about its point of securement on the linker and retracts the front of the nose away from the catch on the interior wall or door jamb.

The linker is also secured to a spindle. The spindle is inserted through a spindle cylinder. The spindle cylinder is in operative contact with the linker assembly and rotatably secured to the body of the storm door. The spindle cylinder allows the handle, nose and linker to be rotated, thereby causing the nose to swing away from the catch. A conventional turn-style handle can be operatively connected to the other end of the spindle in a conventional manner.

In this way, the present invention provides a user with a handle that may be either turned or pushed to disengage the nose from the doorjamb, allowing the door to be opened. These features of novelty and various other advantages that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals indicate corresponding structure throughout the several views.

DETAILED DESCRIPTION OF THE INVENTION

The present invention will be described as it applies to its preferred embodiment. It is not intended that the present invention be limited to the described embodiment. It is intended that the invention cover all modifications and alternatives which may be included within the spirit and scope of the invention.

Figure 1:
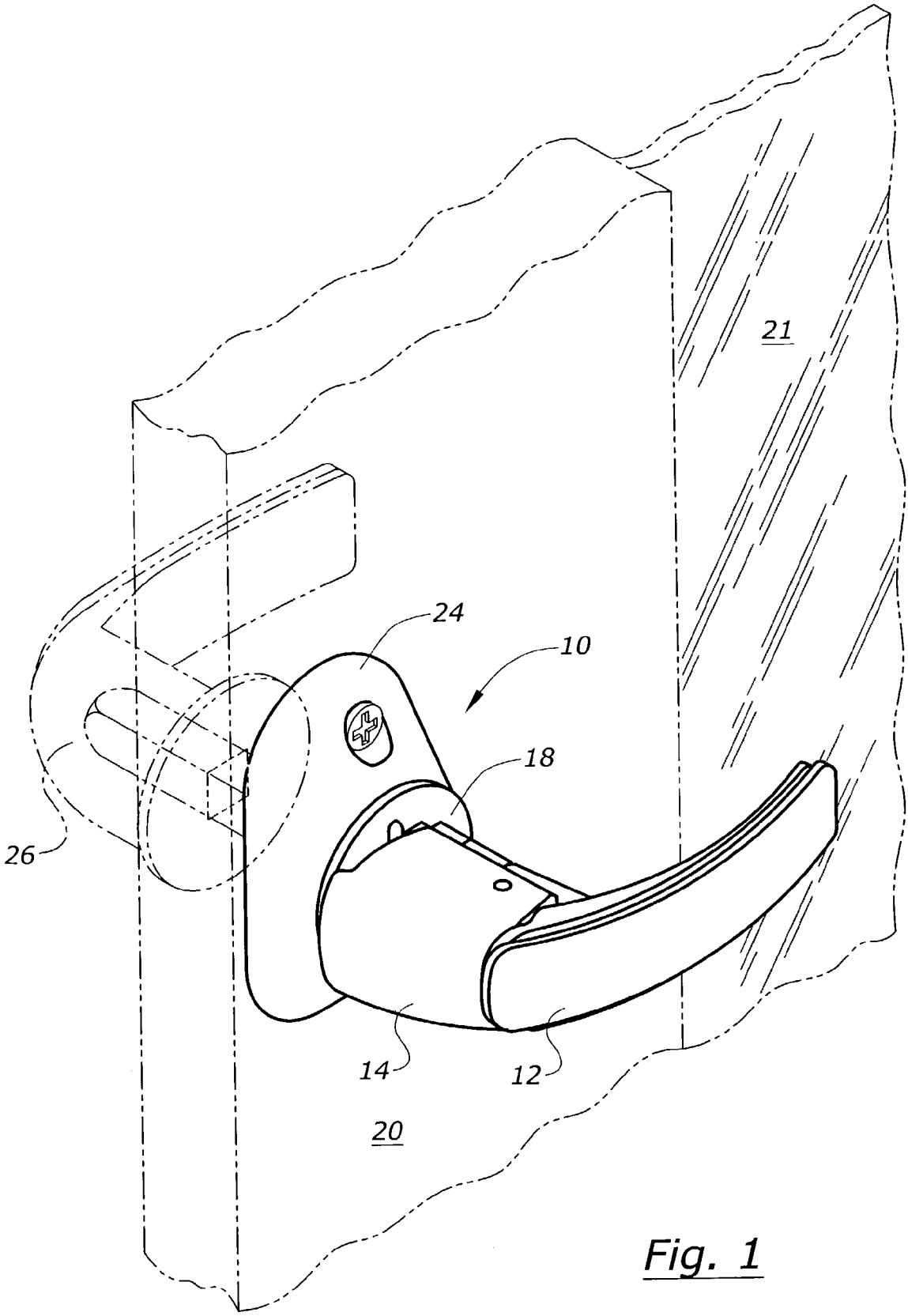
FIG. 1 is a perspective view of the latch mechanism of the present invention as installed on a conventional storm door.

Referring now to the drawings, wherein like reference numerals and letters indicate corresponding structure throughout the several views, and referring in particular to FIG. 1, the latch mechanism 10 of the present invention is shown. Generally, the latch mechanism 10 includes a handle 12 and a nose 14 rotatably mounted to a linker 16 that is secured to the top of a spindle 22. The spindle 22 is rotatably mounted in a spindle cylinder 18 that is secured to the door 20. The door 20 is preferably an aluminum or composite storm door that may include a screen or glass section 21 as is conventional in the art. All of the parts of the latch mechanism 10 can be made of aluminum or any other durable material, such as metal, plastic or wood.

Figure 2A:
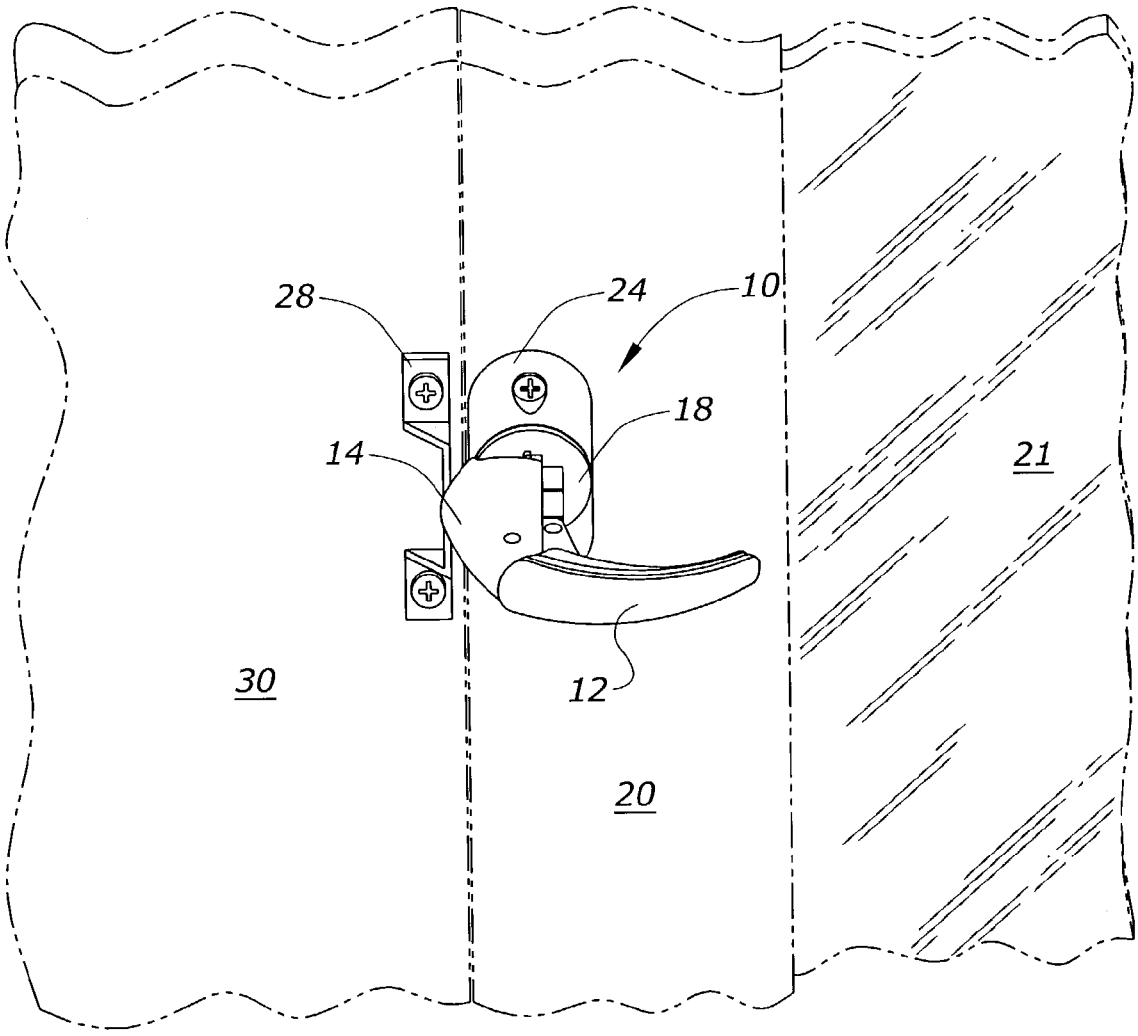
FIG. 2A is a partial frontal perspective view of the latch mechanism of the present invention as installed and in the closed position.
Figure 3:
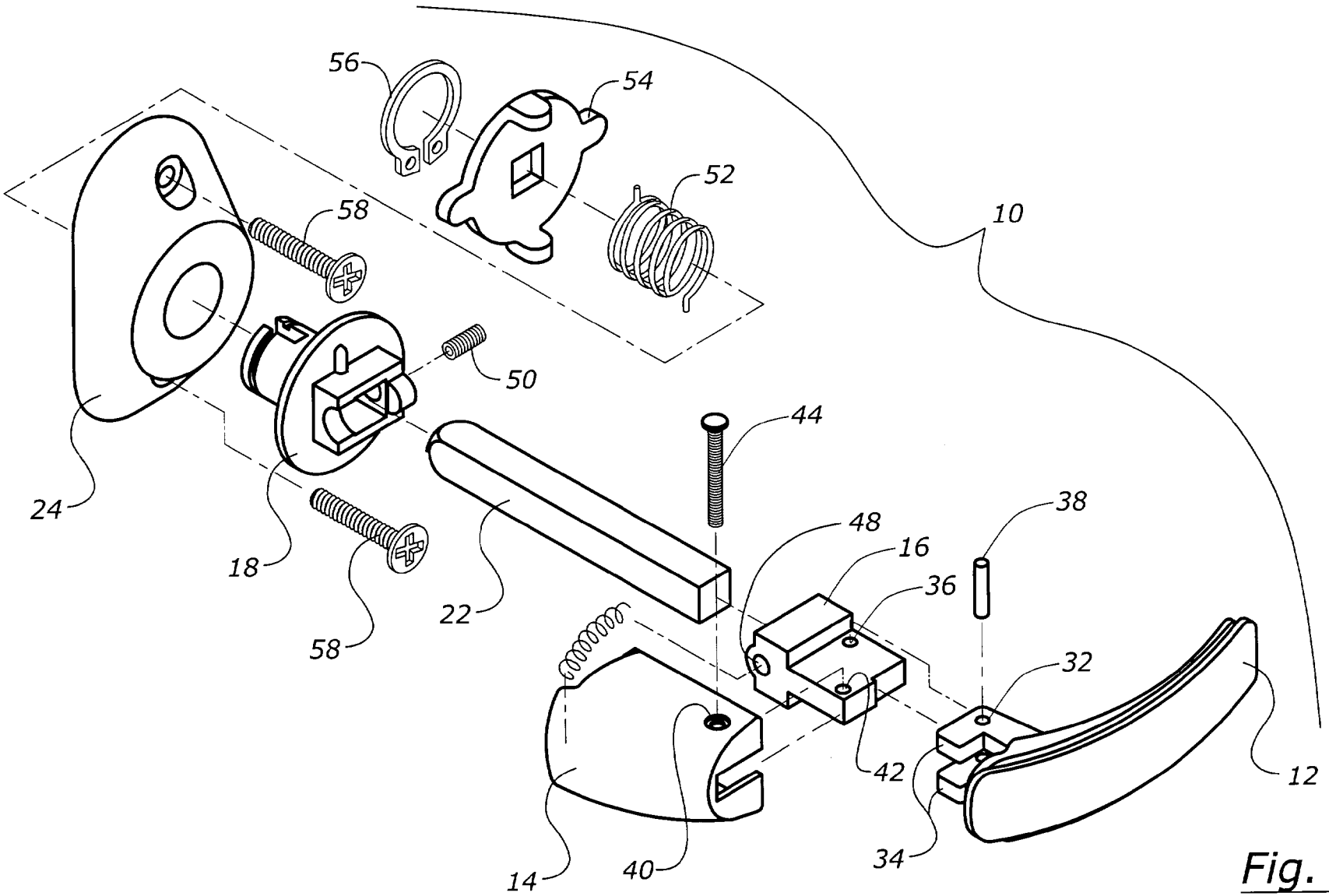
FIG. 3 is an exploded view of the preferred embodiment of the latch mechanism of the present invention.

The spindle 22 passes through the door 20 and is secured to a conventional handle 26 or another latch mechanism 10 as desired. As is shown in FIG. 2A, the latch mechanism 10 is secured to the door 30 such that the nose 14 contacts a catch 28. This is the closed position. The latch mechanism 10 is preferably made of several parts as is shown in FIG. 3. Each part shall now be discussed.

The handle 12, shown in FIG. 3, preferably includes a handle pivot hole 32 and a handle cam 34. The handle pivot hole 32 corresponds to a hole 36 in the linker 16. The handle 12 is rotatably secured to the linker 16 about the holes 32, 36 by a pin 38 or other securing device.

Figure 2B:
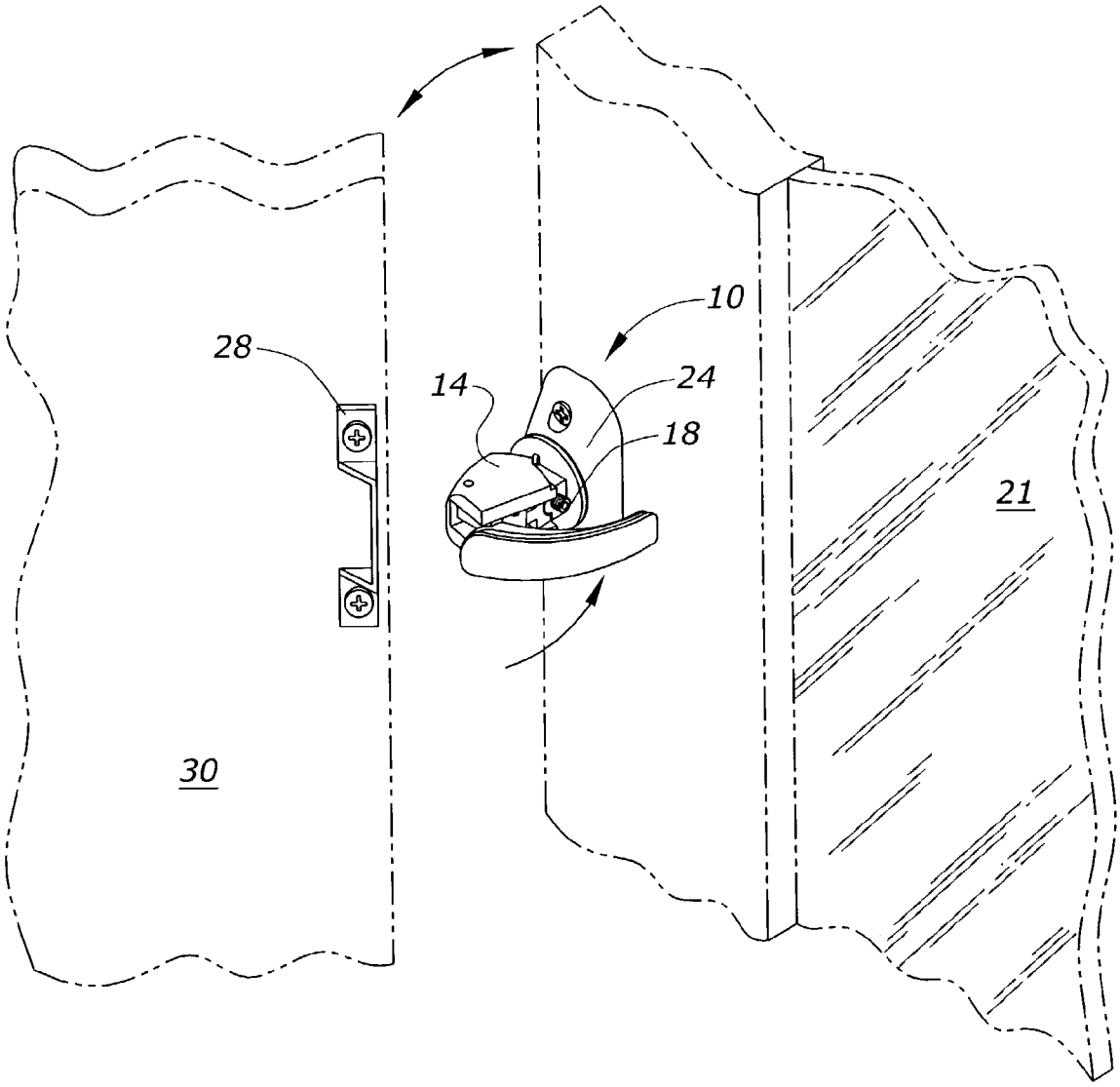
FIG. 2B is a partial frontal perspective view of the latch mechanism of the present invention as installed and in the open-pushed position.

The nose 14 preferably includes a nose pivot hole 40. The nose 14 is thereby rotatably secured to the linker 16 by a pin 44 or other securing device that passes through the nose pivot hole 40 as well as the corresponding hole 42 in the linker 16. In this manner the nose 14 and the handle 12 can rotate about a pair of generally vertical axis on the linker 16. Rotating the handle 12 on the linker 16 in this manner occurs when a user pushes the handle 12. This causes the handle cam 34 to contact the upper inside portion of the nose 14, pivoting the nose 14 about the nose pivot hole 40 and retracting the front of the nose 14 from the catch 28 on the interior wall 30 or doorjamb. In this manner, the door 20 is opened as shown in FIG. 2B. When the user releases the handle 12, a spring 46 pushes the nose 14 and the handle 12 back into their original positions. The spring 46 is secured to the inside of the nose 14 and to a hole 48 on the linker 16. Alternatively, a pin (not shown) may be inserted into hole 48 and used to secure the spring 46.

The linker 16 also includes a spindle receiving notch (not shown). A spindle 22 is inserted into the spindle receiving notch and secured in place by a screw, glue, or any other conventional means. A spindle cylinder 18 is then placed on the spindle 22. The spindle 22 fits through a corresponding spindle hole in the spindle cylinder 18. The fit should be tight enough to hold the spindle 22 in place. The spindle 22 may rotate when secured in the spindle cylinder 18.

The spindle cylinder 18 is secured in place just below the linker 16 and may interlock with the linker 16 through corresponding notches shaped into the sides of the respective parts. The spindle cylinder 18 is secured in place by tightening a screw 50 or other securement device through a corresponding hole.

The spindle cylinder 18 is secured to the door by a mounting bracket 24. A spring 52 is then placed around the base of the spindle cylinder 18 and on the underside of the mounting bracket 24. A spring retaining member 54 is then placed over the spring 52 and around the spindle 22. The spring retaining member 54 includes a pair of ears bent to contact corresponding tabs on the spring 52. In this manner, the spring force is transferred to provide resistance to the turning of the spindle 22 and to return the spindle 22 and the handle 12 to their original positions. A retaining clip 56 is finally placed in the retaining groove on the spindle cylinder 18 to secure the spindle cylinder 18 in place.

Figure 2C:
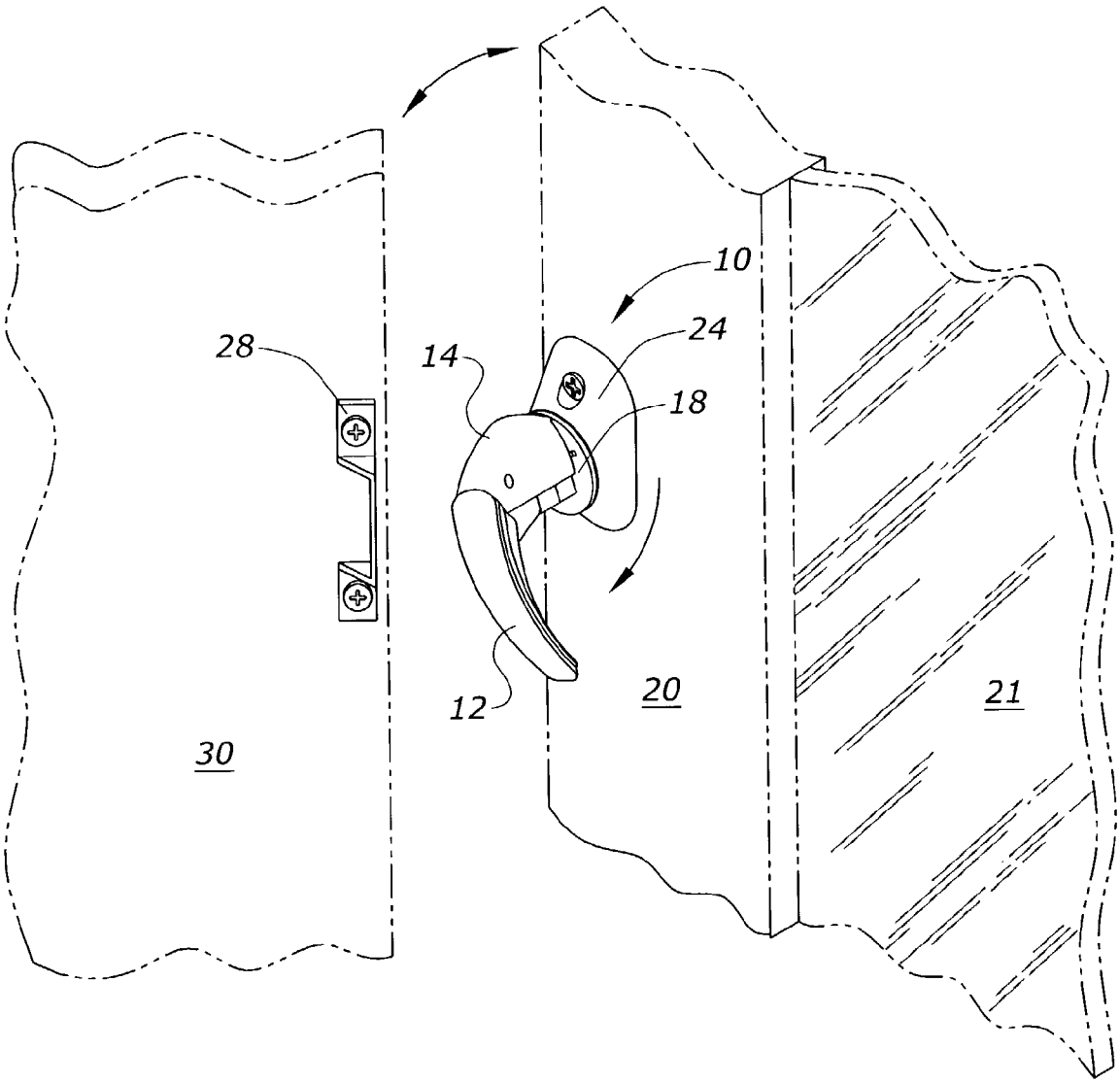
FIG. 2C is a partial frontal perspective view of the latch mechanism of the present invention as installed and in the open-turned position.

When secured, the spindle cylinder 18 allows the user to rotate the handle 12, nose 14 and linker 16 to turn the nose 14 away from the catch 28 and the door jamb or interior wall 30. This allows the user to open the door 20 as is shown in FIG. 2C.

In this manner it can be seen that the latch mechanism 10 of the present invention allows a user to either push the handle 12 (FIG. 2B) or turn the handle 12 (FIG. 2C), removing the nose 14 from an engaged or closed position (FIG. 2A) with the doorjamb or interior wall 30, to open the door.

A preferred embodiment of the present invention has been set forth above. It should be understood by one of ordinary skill in the art that modifications may be made in detail, especially in matters of shape, size and arrangement of parts. Such modifications are deemed to be within the scope of the present invention which is to be limited only by the broad general meaning of the terms in which the appended claims are expressed.

What is claimed is:

1. A push or turn latch mechanism for a screen door, the latch mechanism comprising:

a spindle having an first end and an opposite second end;

a linker attached to the first end of the spindle;

a handle pivotally mounted to the linker about a first vertical axis, the handle including a cammed portion;

a nose pivotally mounted to the linker about a second vertical axis wherein rotation of the handle about the first vertical axis causes the nose to rotate about the second vertical axis;

a spindle cylinder engaging the spindle for rotation about a third horizontal axis, wherein pivoting the handle about the third horizontal axis causes rotation of the spindle about the third horizontal axis.

2. The latch mechanism of claim 1 wherein a spring is positioned between the nose and the linker.

3. The latch mechanism of claim 1 wherein the handle is pinned to the linker.

4. The latch mechanism of claim 1 wherein the nose is pinned to the linker.

5. The latch mechanism of claim 1 wherein the spindle is secured to the spindle cylinder with a screw.

6. The larch mechanism of claim 1 wherein a spring is operatively connected to the spindle.

7. The latch mechanism of claim 1 further comprising a second handle operatively connected to the second end of the spindle.

8. A screen door assembly including an easy to use latch mechanism, the screen door comprising:

a screen door pivotable about a vertical axis from a closed position to an open position; and a latch assembly mounted to the screen door, the latch assembly including a spindle passing through the screen door and having an interior end opposite an exterior end, a linker attached to the interior end of the spindle, a handle pivotally mounted to the linker about a vertical axis, a nose pivotally mounted to the linker about a vertical axis, a mounting bracket, a spindle cylinder secured to the mounting bracket for rotation about a horizontal axis and having an opening through which the exterior end of the spindle passes, wherein the handle is rotatable about either the vertical axis or the horizontal axis.

9. The screen door assembly of claim 8 further comprising a handle operatively secured to the spindle on the exterior of the storm door.

10. A push or turn latch mechanism for a screen door, the latch mechanism comprising:

a spindle having a first end and an opposite second end;

a linker attached to the first end of the spindle;

a handle pivotally mounted to the linker about a first axis, the handle including a cammed portion;

a nose pivotally mounted to the linker about a second axis wherein rotation of the handle about the first axis causes the cammed portion to contact the nose and rotate the nose about the second axis;

a spindle cylinder engaging the spindle for rotation about a third axis, wherein pivoting the handle in a direction transverse to the first axis causes rotation of the spindle about the third axis;

wherein the spindle is secured to the spindle cylinder with a screw.

11. The latch mechanism of claim 10 wherein a spring is positioned between the nose and the linker.

12. The latch mechanism of claim 10 wherein the handle is pinned to the linker.

13. The latch mechanism of claim 10 wherein the nose is pinned to the linker.

14. The latch mechanism of claim 10 wherein a spring is operatively connected to the spindle.

15. The latch mechanism of claim 10 further comprising a second handle operatively connected to the second end of the spindle.

* * * * *

UNITED STATES PATENT AND TRADEMARK OFFICE

CERTIFICATE OF CORRECTION

PATENT NO. : 7,055,873 B2
APPLICATION NO. : 10/427023
DATED : June 6, 2006
INVENTOR(S) : Qing, Wu Feng It is certified that error appears in the above-identified patent and that said Letters Patent is hereby corrected as shown below:

On the title page item (54) and col. 1, line 1,
STORM DOOR PUSH OR TURN LOCK --AND--

Col. 4, claim 6, line 55:
6. The "larch" --latch-- mechanism of claim 1 wherein a spring is Signed and Sealed this Eighth Day of August, 2006

JON W. DUDAS
*Director of the United States Patent and Trademark Office*